US009663886B2

(12) United States Patent
Mackay et al.

(10) Patent No.: US 9,663,886 B2
(45) Date of Patent: May 30, 2017

(54) LAUNDRY TREATING APPLIANCE HAVING A DISPENSING DRAWER

(75) Inventors: Michael R. Mackay, Buchanan, MI (US); Robert J. Pinkowski, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1834 days.

(21) Appl. No.: 12/856,828

(22) Filed: Aug. 16, 2010

(65) Prior Publication Data

US 2012/0036901 A1 Feb. 16, 2012

(51) Int. Cl.
*D06F 29/00* (2006.01)
*D06F 39/02* (2006.01)

(52) U.S. Cl.
CPC ..... *D06F 29/00* (2013.01); *D06F 39/02* (2013.01); *D06F 39/022* (2013.01)

(58) Field of Classification Search
USPC ..... 68/17 R
See application file for complete search history.

(56) References Cited

U.S. PATENT DOCUMENTS

| | | | | |
|---|---|---|---|---|
| 5,007,254 | A * | 4/1991 | Wolfe et al. | 68/17 R |
| 7,275,552 | B2 | 10/2007 | DeWeerd et al. | |
| 2007/0044517 | A1* | 3/2007 | Yang et al. | 68/17 R |
| 2008/0256723 | A1* | 10/2008 | Kim et al. | 8/159 |
| 2009/0100881 | A1 | 4/2009 | Dahlke | |
| 2009/0145177 | A1* | 6/2009 | Kim et al. | 68/13 R |

FOREIGN PATENT DOCUMENTS

| | | | |
|---|---|---|---|
| DE | 102007050920 | B3 | 12/2008 |
| DE | 102009030288 | A1 | 1/2010 |
| EP | 2003237 | A1 | 12/2008 |

OTHER PUBLICATIONS

German Search Report for DE102011051796, Mar. 1, 2012.

* cited by examiner

*Primary Examiner* — Michael Barr
*Assistant Examiner* — Levon J Shahinian

(57) ABSTRACT

A dispensing system for a laundry treating appliance may include a drawer slidable between a closed position and an open position, a cartridge recess formed in a portion of the drawer configured to receive the cartridge of treating chemistry, and an aperture through which the cartridge is viewable and formed in the portion of the drawer.

28 Claims, 5 Drawing Sheets

LAUNDRY TREATING APPLIANCE HAVING A DISPENSING DRAWER

BACKGROUND OF THE INVENTION

A laundry treating appliance may be used to treat laundry according to a programmed treatment cycle. A laundry treatment cycle may require using treating chemistry to remove soil and stain from the surface of the laundry being treated by the laundry treating appliance. The treating chemistry may be in a solid or liquid form.

The laundry treating appliance may have a dispensing system configured to supply treating chemistry to the laundry within a laundry treating chamber. The dispensing system may include a drawer in which treating chemistry is loaded. The treating chemistry may be stored in a cartridge that is then placed in the drawer. The treating chemistry may be dispensed from the cartridge to the laundry treating chamber. The cartridge may be removed from the drawer when empty or when a different treating chemistry is required to treat the laundry.

BRIEF DESCRIPTION OF THE INVENTION

The invention relates to a laundry treating appliance having a cabinet with an interior, a laundry treating chamber located within the interior, and a dispensing system configured to supply treating chemistry to the laundry treating chamber. The dispensing system includes a drawer, a cartridge recess formed in a portion of the drawer configured to receive a cartridge of treating chemistry, and an aperture formed in the portion of the drawer, wherein the drawer is slidable between a closed position and an open position, where at least a portion of the aperture is exterior of the cabinet and the cartridge is viewable through at least a portion of the aperture when the drawer is viewed from below.

DESCRIPTION OF AN EMBODIMENT OF THE INVENTION

Figure 1:
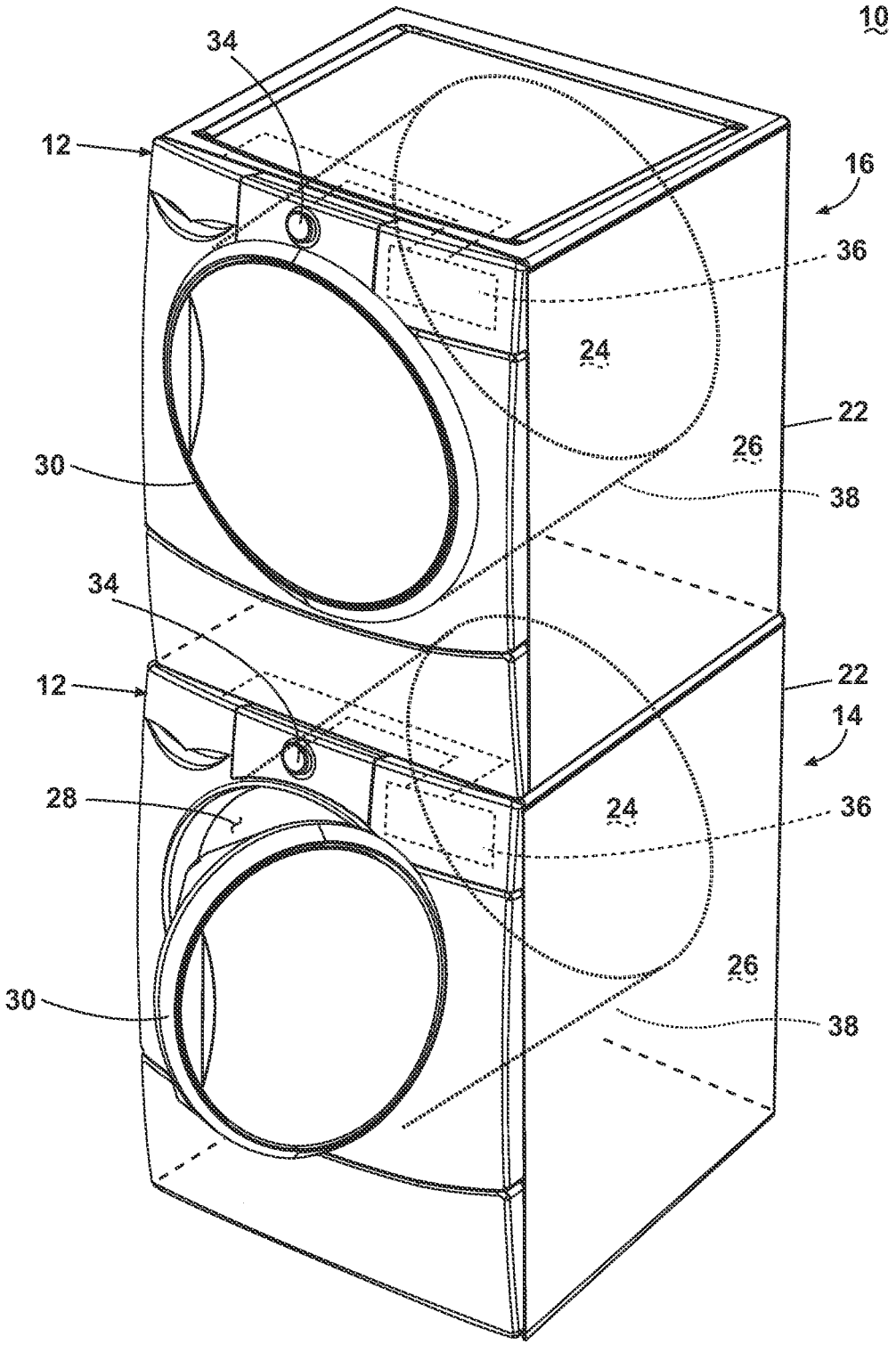
FIG. 1 is a perspective view of a modular laundry system according to one embodiment of the invention, the modular laundry system having two laundry treating appliances in a stacked configuration, with each laundry treating appliance having a dispensing system.

FIG. 1 is a perspective view of a modular laundry system 10 according to one embodiment of the invention, the modular laundry system 10 having at least one dispensing system 12. As illustrated, the modular laundry system 10 may have a lower laundry treating appliance 14 and an upper laundry treating appliance 16 that may be vertically stacked above the lower laundry treating appliance 14. Each laundry treating appliance 14, 16 includes a dispensing system 12. In another embodiment, only one of the laundry treating appliances may include the dispensing system 12. In yet another embodiment, a single laundry treating appliance with the dispensing system 12 may be used instead of the dual-appliance modular laundry system 10 shown in FIG. 1.

As illustrated, the lower laundry treating appliance 14 and the upper laundry treating appliance 16 may be a clothes dryer and a washing machine, respectively. Alternatively, the laundry treating appliances 14, 16 may be any appliance which performs a cycle of operation on laundry, other non-limiting examples of which include a dispensing dryer, a refreshing/revitalizing machine, a non-aqueous laundry system, an extractor, and a combination washing machine and dryer.

It should be noted that the stacked arrangement of the illustrated embodiment is not limiting to the invention. It merely serves to illustrate the invention. The invention may be implemented in a single laundry treating appliance, which may be placed on the floor or in a position elevated from the floor. Structures other than another laundry treating appliance may be used to elevate the laundry treating appliance. For example, the laundry treating appliance may be mounted in a cabinet or similar structure.

In addition, any two laundry treating appliances may be stacked as illustrated in FIG. 1 or may be oriented in a side-by-side configuration. While the lower laundry treating appliance 14 may be a separate piece from the upper laundry appliance 16, the lower laundry treating appliance 14 could be integrated with the upper laundry treating appliance 16. It is also within the scope of the invention for one laundry treating appliance 14, 16 with the dispensing system 12 to be stacked with a non-laundry treating appliance, such as a dishwasher. Still further, it is within the scope of the invention for one laundry treating appliance 14, 16 with the dispensing system 12 to be stacked with furniture, cabinetry, or other non-appliance structures.

Each laundry treating appliance 14, 16 may include a cabinet 22 having an interior 26, a laundry treating chamber 24 located within the interior 26 of the cabinet 22, a door 30 movably mounted to the cabinet 22, and a dispensing system 12.

Each laundry treating appliance 14, 16 may further include a parameter selector 34 and a controller 36. The controller 36 may be coupled with various working components of the laundry treating appliance 14, 16 to control the operation of the laundry treating appliance 14, 16. The controller 36 may be operably coupled to the parameter selector 34 which may form a user interface provided on the exterior of the cabinet 22. The parameter selector 34 may be in the form of a rotatable knob, and may be used to select a programmed treatment cycle.

The cabinet 22 may include an access opening 28 that provides access to the laundry treating chamber 24, and the door 30 may be configured to selectively close the access opening 28. Each laundry treating appliance 14, 16 may include a rotatable drum 38 which defines the laundry treating chamber 24.

The dispensing system 12 may be configured to hold at least one treating chemistry and to provide the treating chemistry to the laundry treating chamber 24 according to the programmed treatment cycle. The dispensing system 12 may be operably coupled with the controller 36 to control a dose amount and a dispensing frequency of the treating chemistry from the dispensing system 12 to the laundry treating chamber 24.

Figure 2:
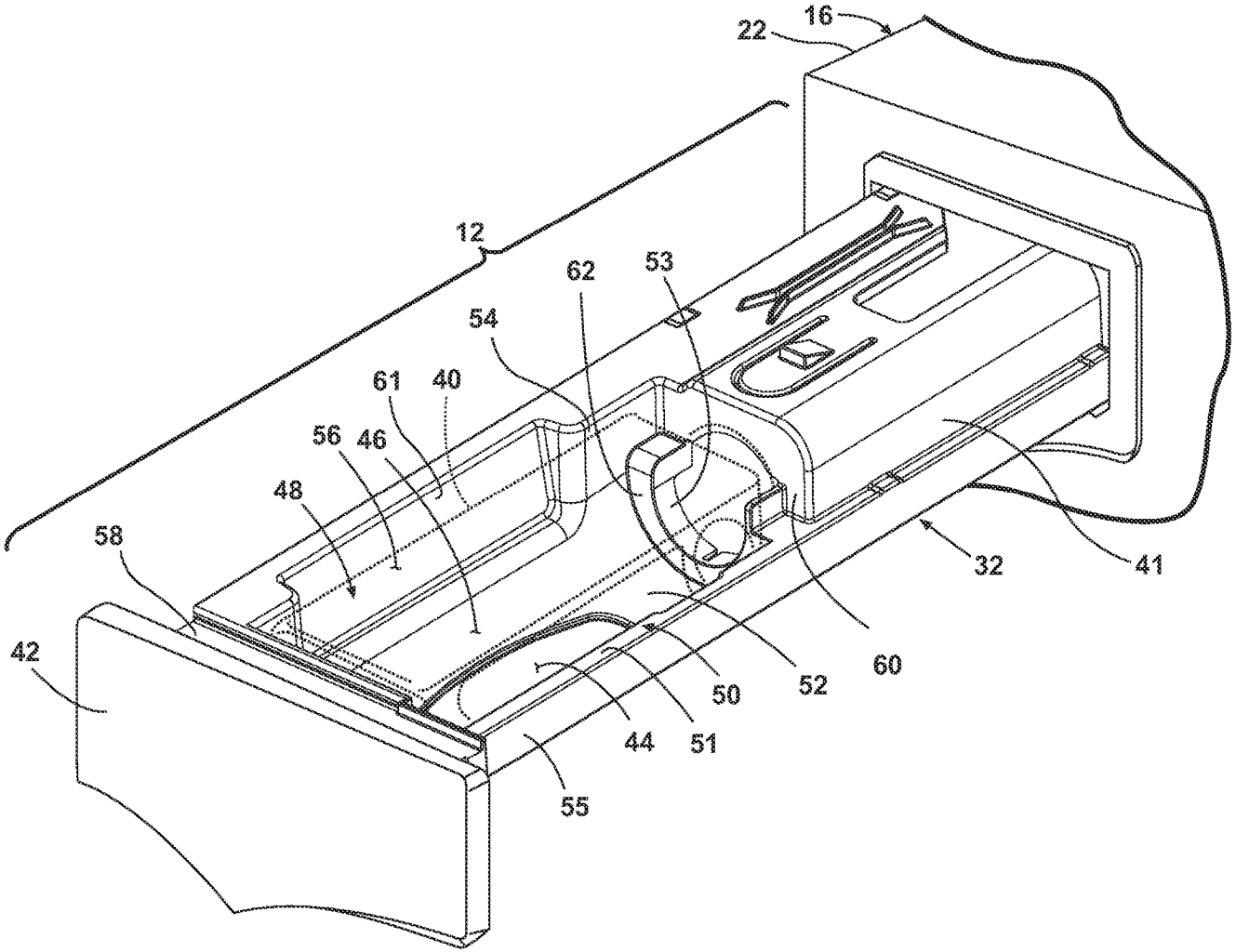
FIG. 2 is a perspective view of the dispensing system of the upper laundry treating appliance of FIG. 1 having a cartridge of treating chemistry (in phantom) disposed inside the drawer, with the drawer shown in an opened position.

FIG. 2 is a perspective view of the dispensing system 12 of the upper laundry treating appliance 16. The dispensing system 12 may include a drawer 32 and a cartridge recess 46 formed in a portion of the drawer 32 and that is configured to receive a cartridge 40 of treating chemistry. The drawer 32 is moveably mounted to the cabinet 22 of the laundry treating appliance 16 between an open position, shown in FIG. 2, in which the cartridge recess 46 may be accessed, for example to insert or remove the cartridge, and a closed position, shown in FIG. 1, in which the drawer 32 may be substantially received within the interior 26 of the cabinet 22.

The drawer 32 includes a drawer body 41 that is slidably mounted to the cabinet 22. A dispensing drawer handle 42 may be provided on the drawer body 41 to facilitate movement of the drawer 32 between the closed and open positions.

The cartridge recess 46 may be provided in the drawer body 41 and may be defined by a front wall 58 and a rear wall 60 which are joined together by opposing first and second side walls 54, 55 and a bottom wall 52 extending between the side walls 54, 55. The shape and the geometrical dimensions of the surface of the cartridge recess 46 may be configured to ensure that the cartridge 40 may snugly fit within the cartridge recess 46 and may permit the drawer 32 to be closed.

An aperture 44 may be formed in the cartridge recess 46. As illustrated, the aperture 44 is provided in the bottom wall 52 of the cartridge recess 46 and is open to the cartridge recess 46. In another embodiment, the aperture 44 may be provided with a translucent or transparent pane such that the aperture 44 is closed to the cartridge recess 46. In either case, the aperture 44 may be used to view the cartridge 40 within the cartridge recess 46 when the drawer 32 is viewed from below. While a single aperture 44 may be provided on the portion of the drawer 32, in another embodiment, more than a single aperture 44 may be provided on the portion of the drawer 32.

Figure 3:
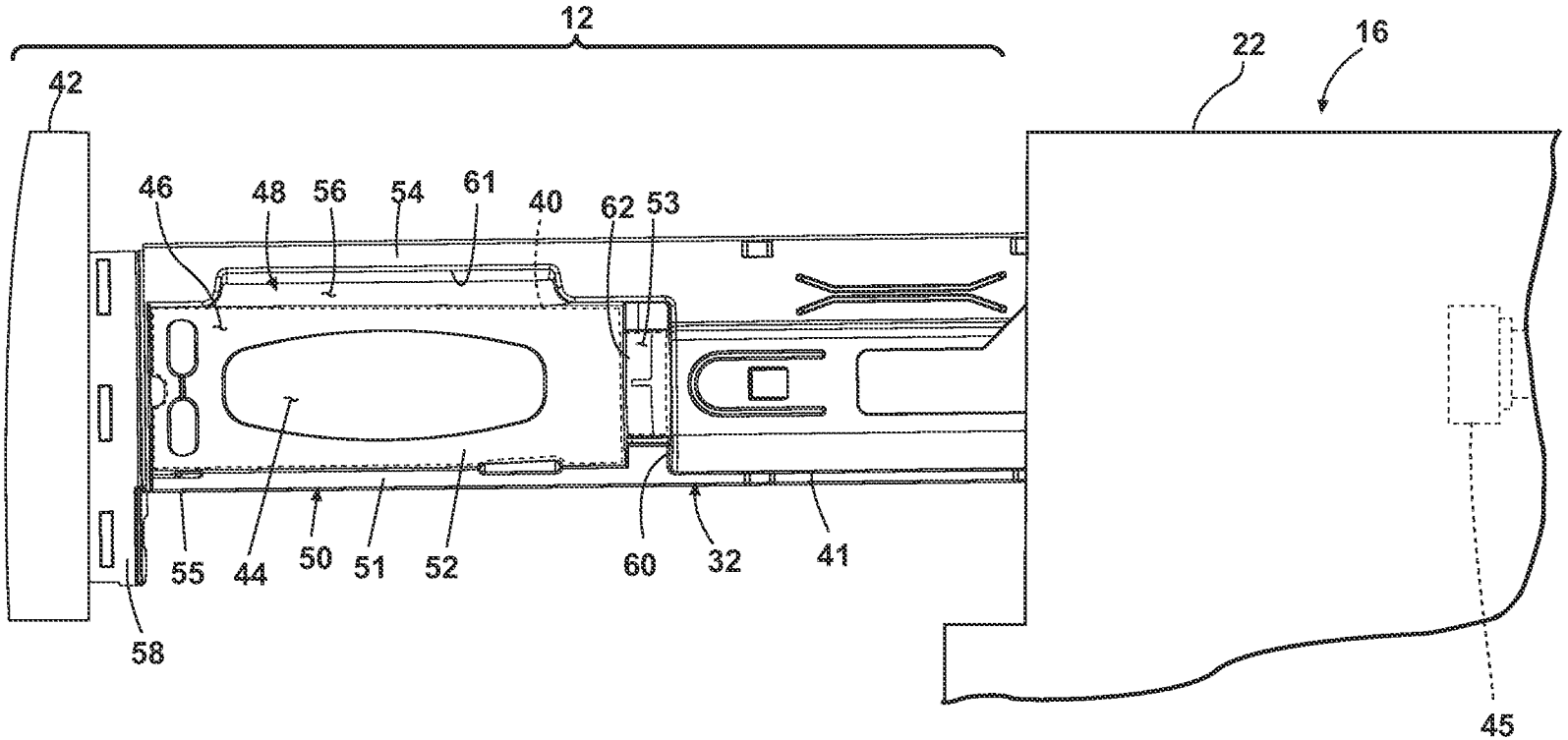
FIG. 3 is a top view of the dispensing system of FIG. 2.

Referring to FIG. 3, the laundry treating appliance 16 may have a coupling 45 for fluidly connecting the cartridge 40 to the laundry treating chamber 24 (FIG. 1) such that treating chemistry may be dispensed from the cartridge 40 into the laundry treating chamber 24. As illustrated, the coupling 45 may be carried by the cabinet 22, and may include a valve or a switch that is opened by movement of the drawer 32 to the closed position, which may bring a portion of the cartridge 40 into contact with the coupling 45. While not illustrated, suitable valves, conduits, nozzles etc. may be provided to permit dispensing of treating chemistry from the cartridge 40 to the laundry treating chamber 24 via the coupling 45. In another embodiment, the coupling 45 may be carried by the drawer 32, and may be fluidly connected to the cartridge 40 when the drawer 32 slides into the cabinet 22.

The rear wall 60 of the cartridge recess 46 may include a support boss 53 which may be used to dock an outlet portion of the cartridge 40 such that the cartridge 40 may be properly positioned in the drawer 32. The support boss 53 is aligned with the coupling 45 within the cabinet 22, such that when the drawer 32 is in the closed position, the outlet portion of the cartridge 40 may be coupled with the coupler 45.

Referring back to FIG. 2, the drawer 32 may have at least one of an offset area 48 and a relief area 50 adjacent the cartridge recess 46 to enable a user to grasp the cartridge 40 for removal. In the illustrated embodiment the drawer 32 is provided with one offset area 48 and one relief area 50. However, it is within the scope of the invention for the drawer 32 to be provided with other numbers and/or combinations of offset and relief areas 48, 50.

The offset area 48 may be formed by an inset or laterally-recessed portion 61 of the first side wall 54. The recessed portion creates a space or gap 56 between the first side wall 54 and the cartridge 40, when the cartridge 40 is recessed by the cartridge recess 46. The offset area 48 may permit a user to insert one or more fingers into the gap 56 between the first side wall and the cartridge 40 to remove the cartridge 40 from the cartridge recess 46.

The relief area 50 may be formed by a reduced-height portion 51 of the second side wall 55. The reduced-height portion 51 may be reduced in height in comparison to the cartridge 40 in the cartridge recess 46. As illustrated, the reduced-height portion 51 may extend substantially along the second side wall 55, and may further be reduced in height as compared with any or all of the front, rear, and first side walls 54. It is noted that the front, rear, and first side walls 54 of the cartridge recess 46 may be configured to have the same or a greater height in comparison to the cartridge 40 in the cartridge recess 46. The relief area 50 may permit a portion of the cartridge 40 to be exposed within the cartridge recess 46 to facilitate gripping of the cartridge 40 when removing the cartridge 40 from the cartridge recess 46.

As is shown in the illustrated embodiment, the offset and relief areas 48, 50 may advantageously be provided on opposing sides of the cartridge recess 46 to facilitate gripping the cartridge 40 on opposite sides with a single hand during removal. According to one potential gripping configuration, a user may wrap a single hand around the cartridge 40, with one or more fingers of the hand engaging the cartridge 40 via insertion into the offset area 48 and the thumb of the hand engaging the cartridge 40 via the reduced height of the relief area 50.

Figure 4:
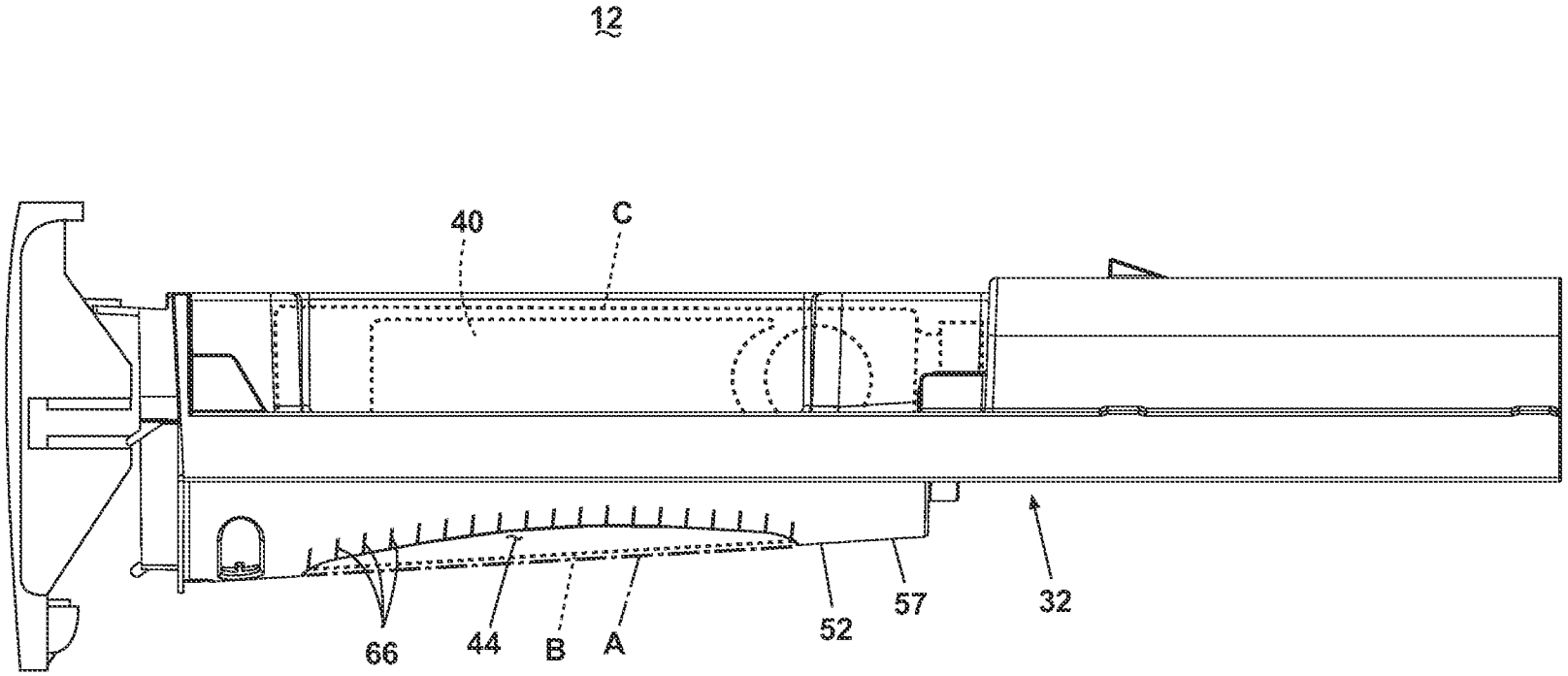
FIG. 4 is a side view of the drawer of the dispensing system of FIG. 2.

FIG. 4 is a side view of the drawer 32 of the dispensing system 12. As illustrated, the bottom wall 52 of the cartridge recess 46 may be sloped relative to a horizontal plane; phantom line A illustrates the general shape of the angled bottom wall 52 without the aperture 44. When the cartridge 40 (shown in phantom) is received by the drawer 32, the cartridge includes a lower surface B, which also may be sloped relative to the horizontal plane, while an upper surface C of the cartridge may be generally parallel to the horizontal plane. In yet another embodiment, the cartridge 40 may include flat bottom surface, with the cartridge 40 may have an angled bottom portion that is viewable through the aperture 44 in the drawer 32.

The bottom wall 52 may include a lower surface 57 on which a graduated scale 66 may by provided for indicating the presence and/or amount of treating chemistry in the cartridge 40. As illustrated, the graduated scale 66 may be provided adjacent the aperture 44. When used with a translucent or transparent cartridge 40, the present of treating chemistry in the cartridge 40 can be determined, and the graduated scale 66 can be used to determine how much treating chemistry is available. The graduated scale 66 may be formed on the drawer 32 by an engraving or printing process. While shown as being provided on the drawer 32, the graduated scale 66 may be alternatively provided on the cartridge 40 such that the graduated scale 66 may be visible through the aperture 44 when the cartridge 40 is received by the drawer 32.

Figure 5:
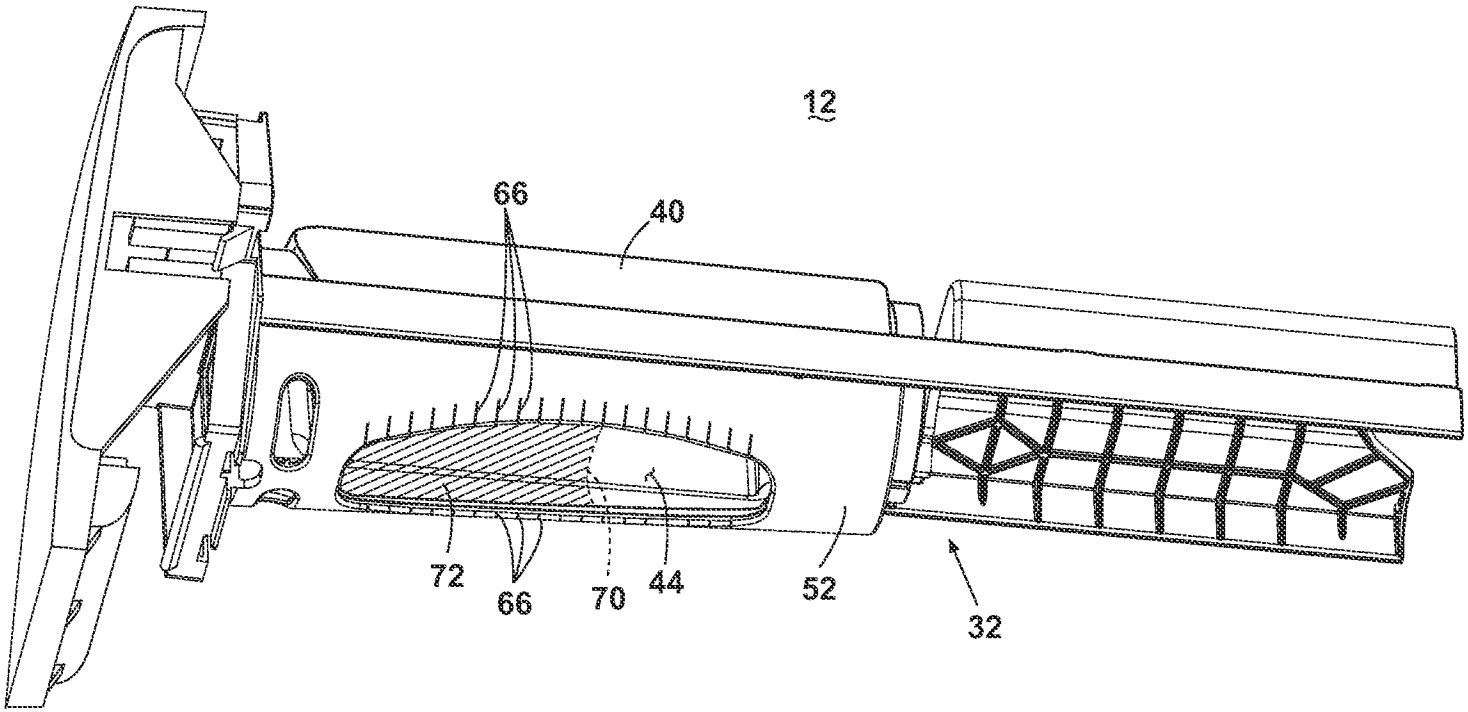
FIG. 5 is a bottom perspective view of the drawer of the dispensing system of FIG. 2, the drawer containing the cartridge of treating chemistry.

FIG. 5 is a bottom perspective view of the drawer 32 of the dispensing system 12, with the cartridge 40 of treating chemistry disposed inside the drawer 32. As shown, with the drawer 32 in the open position, a portion of the aperture 44 is exterior of the cabinet 22, such that the cartridge 40 is viewable through the aperture 44 when the drawer 32 is viewed from below. This configuration has the benefit of providing visual confirmation to the user that the cartridge 40 is installed in the drawer 32, and will also provide visual confirmation when a cartridge is not installed. This is especially beneficial when employed with the stacked modular laundry system 10 of FIG. 1. In this case, while it may be relatively easy to view the top side of the dispensing system 12 of the lower laundry treating appliance 14, it is less easy to view the top side of the dispensing system 12 of the upper laundry treating appliance 16. By providing the aperture 44, the user is able to confirm the presence or absence of the cartridge 40 from beneath the dispensing system 12. The cartridge 40 of treating chemistry may have a light transmitting material such that treating chemistry retained in the cartridge 40 may be viewable through the cartridge 40. Furthermore, by providing the graduated scale 66, the user may be able to determine the amount of treating chemistry within the cartridge 40.

The offset and relief areas 48, 50 provide further benefits to the dispensing system 12. Effectively, the offset and relief areas 48, 50 provide increased accessibility to a cartridge within a dispensing system 12, while maintaining a secure fit between the cartridge 40 and the drawer 32. The offset and relief areas 48, 50 permit the user to remove or insert the cartridge 40 with a single hand. Furthermore, when employed with the stacked modular laundry system 10 of FIG. 1, the offset and relief areas 48, 50 may provide tactile feedback to the user when inserting or removing the cartridge 40 into or from the drawer 32.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a cabinet having an interior and having an access opening providing access to the interior;

a laundry treating chamber located within the interior and accessible through the access opening;

a door movably mounted to the cabinet configured to selectively close the access opening; and a dispensing system configured to supply treating chemistry to the laundry treating chamber and comprising:

a drawer slidably coupled with the cabinet for movement between a closed position and an open position and having an angled bottom wall;

a cartridge recess formed in a portion of the drawer, defined at least in part by the angled bottom wall, and configured to receive a cartridge of treating chemistry; and an aperture at least partially formed in the angled bottom wall of the cartridge recess;

wherein when the drawer is in the closed position, the drawer is received within the interior, and when the drawer is in the open position at least a portion of the aperture is exterior of the cabinet and the cartridge is viewable through at least a portion of the aperture when the drawer is viewed from below.

2. The laundry treating appliance of claim 1 wherein the drawer has a relief area or an offset area adjacent the cartridge recess to enable a user to grasp the cartridge for removal.

3. The laundry treating appliance of claim 2 wherein the drawer has at least one side wall that partially defines the cartridge recess, and the relief area is formed by a reduced-height portion of the at least one side wall.

4. The laundry treating appliance of claim 2 wherein the drawer has at least a first side wall that partially defines the cartridge recess, and the offset area is formed in the first side wall to create a gap between the first side wall and a cartridge received in the cartridge recess.

5. The laundry treating appliance of claim 4 wherein the drawer has at least a second side wall that partially defines the cartridge recess, and the relief area is formed by a reduced-height portion of the second side wall.

6. The laundry treating appliance of claim 1 wherein the angled bottom wall comprises a graduated scale on a lower surface of the angled bottom wall that indicates the amount of treating chemistry in the cartridge.

7. The laundry treating appliance of claim 6 wherein the portion of the drawer comprising the angled bottom wall and the graduated scale is adjacent the aperture such that a treating chemistry level seen through the aperture may be compared to the graduated scale to indicate the amount of treating chemistry in the cartridge.

8. The laundry treating appliance of claim 7 wherein the aperture extends substantially along the entire length of the cartridge recess.

9. The laundry treating appliance of claim 1 wherein the aperture comprises a window.

10. The laundry treating appliance of claim 9 wherein the window comprises a light transmitting material.

11. The laundry treating appliance of claim 1 wherein the aperture opens into the cartridge recess.

12. The laundry treating appliance of claim 1, further comprising a coupling configured to fluidly connect with the cartridge of treating chemistry, wherein the coupling is carried by one of the drawer and the cabinet.

13. The laundry treating appliance of claim 1, further comprising a drum within the cabinet and defining the treating chamber.

14. A modular laundry system comprising:

a lower laundry treating appliance;

an upper laundry treating appliance vertically stacked above the lower laundry treating appliance and comprising:

a cabinet having an interior and having an access opening providing access to the interior;

a laundry treating chamber located within the interior and accessible through the access opening; and a door movably mounted to the cabinet configured to selectively close the access opening; and a dispensing system provided with the upper laundry treating appliance and configured to supply treating chemistry to the laundry treating chamber of the upper laundry treating appliance, the dispensing system comprising:

a drawer slidably coupled with the cabinet for movement between a closed position and an open position and wherein the drawer comprises an angled bottom wall;

a cartridge recess formed in a portion of the drawer, defined at least in part by the angled bottom wall, and configured to receive a cartridge of treating chemistry; and an aperture at least partially formed in the angled bottom wall of the cartridge recess;

wherein when the drawer is in the closed position, the drawer is received within the interior, and when the drawer is in the open position, at least a portion of the aperture is exterior of the cabinet and the cartridge is viewable through at least a portion of the aperture when the drawer is viewed from below.

15. The modular laundry system of claim 14 wherein the upper laundry treating appliance comprises one of a washing machine, a clothes dryer, a dispensing dryer, a fabric freshener, a non-aqueous laundry system, a combination washing machine and dryer, and a dishwashing appliance.

16. The modular laundry system of claim 15 wherein the lower laundry treating appliance comprises one of a washing machine, a clothes dryer, a dispensing dryer, a fabric freshener, a non-aqueous laundry system, a combination washing machine and dryer, and a dishwashing appliance.

17. The modular laundry system of claim 14 wherein the drawer has a relief area or an offset area adjacent the cartridge recess to enable a user to grasp the cartridge for removal.

18. The laundry treating appliance of claim 17 wherein the drawer has at least one side wall that partially defines the cartridge recess, and the relief area is formed by a reduced-height portion of the at least one side wall.

19. The laundry treating appliance of claim 17 wherein the drawer has at least a first side wall that partially defines the cartridge recess, and the offset area is formed in the first side wall to create a gap between the first side wall and a cartridge received in the cartridge recess.

20. The laundry treating appliance of claim 19 wherein the drawer has at least a second side wall that partially defines the cartridge recess, and the relief area is formed by a reduced-height portion of the second side wall.

21. The modular laundry system of claim 14 wherein the angled bottom wall comprises a graduated scale on a lower surface of the angled bottom wall that indicates the amount of treating chemistry in the cartridge.

22. The modular laundry system of claim 21 wherein the portion of the drawer comprising the angled bottom wall and the graduated scale is adjacent the aperture such that a treating chemistry level seen through the aperture may be compared to the graduated scale to indicate the amount of treating chemistry in the cartridge.

23. The modular laundry system of claim 22 wherein the aperture extends substantially along the entire length of the cartridge recess.

24. The modular laundry system of claim 14 wherein the aperture comprises a window.

25. The modular laundry system of claim 24 wherein the window comprises a light transmitting material.

26. The modular laundry system of claim 14 wherein the aperture opens into the cartridge recess.

27. The modular laundry system of claim 14 wherein the upper laundry treating appliance further comprises a coupling configured to fluidly connect with the cartridge of treating chemistry, wherein the coupling is carried by one of the drawer and the cabinet.

28. The modular laundry system of claim 14 wherein the upper laundry treating appliance further comprises a drum within the cabinet that defines the laundry treating chamber.

* * * * *